US011674259B2

(12) United States Patent
Shin et al.

(10) Patent No.: US 11,674,259 B2
(45) Date of Patent: Jun. 13, 2023

(54) LAUNDRY TREATMENT APPARATUS

(71) Applicant: LG Electronics Inc., Seoul (KR)

(72) Inventors: Taejin Shin, Seoul (KR); Jinsoo Kim, Seoul (KR); Cheolmin Jang, Seoul (KR); Seongjin Seo, Seoul (KR); Jinman Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 27 days.

(21) Appl. No.: 17/031,251

(22) Filed: Sep. 24, 2020

(65) Prior Publication Data

US 2021/0269964 A1 Sep. 2, 2021

(30) Foreign Application Priority Data

Feb. 27, 2020 (KR) ..... 10-2020-0024365

(51) Int. Cl.
*D06F 39/12* (2006.01)
*D06F 37/22* (2006.01)
*D06F 103/54* (2020.01)

(52) U.S. Cl.
CPC ..... *D06F 39/12* (2013.01); *D06F 37/22* (2013.01); *D06F 2103/54* (2020.02)

(58) Field of Classification Search
CPC ..... D06F 39/12; D06F 37/22; D06F 2103/54
USPC ..... 68/3 r
See application file for complete search history.

(56) References Cited

U.S. PATENT DOCUMENTS

| | | | | |
|---|---|---|---|---|
| 4,972,605 | A | 11/1990 | Montalvo | |
| 2007/0175907 | A1* | 8/2007 | Kempe | D06F 39/12 220/639 |
| 2018/0317739 | A1* | 11/2018 | Rockwell | A47L 15/4274 |
| 2019/0101330 | A1 | 4/2019 | Schurr | |

FOREIGN PATENT DOCUMENTS

| | | |
|---|---|---|
| DE | 102011085191 | 1/2013 |
| JP | 2008161563 | 7/2008 |
| KR | 19950003373 | 4/1995 |
| KR | 2020000003830 | 2/2000 |
| KR | 101950694 B1 * | 2/2019 |

(Continued)

OTHER PUBLICATIONS

KR20190128487A—machine translation (Year: 2019).*

(Continued)

*Primary Examiner* — Tinsae B Ayalew
(74) *Attorney, Agent, or Firm* — Fish & Richardson P.C.

(57) ABSTRACT

An apparatus for laundry treatment includes: a cabinet defining an entrance at one side, a drum defining a space for receiving laundry therein, a duct connected to the drum, a fan configured to move air in the drum into the duct, a heat exchange part including a heat absorption part configured to remove moisture from the air moved into the duct and a heating part configured to heat the air having passed through the heat absorption part, a compressor configured to increase a temperature of the air by compressing a refrigerant having passed through the heat absorption part, a water collecting part configured to receive the moisture removed by the heat exchange part, and a soundproof panel provided at a bottom of a base part that is located at a bottom of the cabinet.

20 Claims, 6 Drawing Sheets

(56) References Cited

FOREIGN PATENT DOCUMENTS

| | | |
|---|---|---|
| KR | 1020190087004 | 7/2019 |
| KR | 1020190128487 | 11/2019 |

OTHER PUBLICATIONS

JP2008161563A—machine translation (Year: 2008).*
KR101950694B1—machine translation (Year: 2019).*
Websuler specification sheet (Year: 2014).*
KR Office Action in Korean Appln. No. 10-2020-0024365, dated Apr. 8, 2021, 11 pages (with English translation).
Office Action in German Appln. No. 10 2020 215 797.9, dated Mar. 2, 2022, 12 pages (with English translation).

* cited by examiner

LAUNDRY TREATMENT APPARATUS

CROSS-REFERENCE TO RELATED APPLICATION

Pursuant to 35 U.S.C. § 119(a), this application claims priority to Korean Patent Application No. 10-2020-0024365, filed on Feb. 27, 2020, the entire contents of which is hereby incorporated by reference in its entirety.

BACKGROUND

Field of the Disclosure

The present disclosure relates to a laundry treatment apparatus.

Discussion of the Related Art

A laundry treatment apparatus is a generic term of a laundry washer, a laundry drier, or a laundry washer & drier.

A related art laundry treatment apparatus equipped with a laundry dry function includes a drum providing a space to receive laundry therein, a duct forming a flow path for resupplying air discharged from the drum to the drum, a first heat exchanger removing moisture contained in air by cooling down the air flowing from the drum into the duct, a second heat exchanger heating the air having passed through the first heat exchanger, and a fan moving the air having passed through the second heat exchanger to the drum. Thus, moisture of laundry located in the drum can be removed using the air dried through the first and second heat exchangers.

As a laundry treatment apparatus for drying is lighter than a laundry treatment apparatus for washing owing to less components, a bottom support structure of the laundry treatment apparatus for drying does not require strong rigidity for a bottom support structure. When a base located at the bottom of such a laundry treatment apparatus is made of metallic material, air-cooling of a compressor part is impossible and corrosion may be caused in a damp environment in a dryer. In addition, when the laundry treatment apparatus for drying is mounted on the laundry treatment apparatus for washing, its base generally uses a light structure of plastic or the like to have a relatively light weight.

Since major components such as a compressor, a heat exchanger, a fan and the like, which are loaded in a laundry treatment apparatus are located at the bottom of the laundry treatment apparatus and operated at high speed, they may cause noise. Particularly, when a base is made of plastic, it has sound insulation performance poorer than that of a base of metallic material, whereby noise leaks out through a floor surface and may be then reflected by an installation surface to radiate.

However, regarding a base of a laundry treatment apparatus published to the public on U.S. Laid-Open Gazette No. 2019-0101330 (Jul. 2, 2017), a double-layered structure including a top plate and a bottom plate is disclosed in a manner that a whole bottom area is configured with double-layered metallic material, whereby total weight is increased problematically. In addition, corrosion may be caused by moisture and performance of a compressor part may become problematic.

SUMMARY

Accordingly, the present disclosure is directed to a laundry treatment apparatus that substantially obviates one or more problems due to limitations and disadvantages of the related art.

One object of the present disclosure is to provide a laundry treatment apparatus, by which noise can be cut off in a manner of improving a bottom base structure of the laundry treatment apparatus.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a laundry treatment apparatus according to one embodiment of the present disclosure may include a cabinet including an entrance at one side, a drum providing a space for storing laundry therein, a duct connected to the drum, a fan forcing air of the drum to flow into the duct, a heat exchange part including a heat absorption part removing moisture from the air flowing into the duct and a heating part heating the air having passed through the heat absorption part, a compressor raising a temperature by compressing a refrigerant having passed through the heat absorption part, a water collecting par storing the moisture removed by the heat exchange part, and a soundproof panel added to a bottom of a base part located at a bottom of the cabinet.

The base part may include a first area overlapping with the soundproof panel and a second area having a bottom side exposed without overlapping with the soundproof panel.

The fan and the compressor may be located in the first area, thereby reducing noise through the soundproof panel.

The entrance may be located at a front side of the cabinet and the first area may be located at a rear side of the base part, whereby components generating considerable noise can be disposed in a backside direction.

The water collecting part may further include a drain pump located in the first area to remove the moisture removed from the air passing through the heat exchange part from the heat exchange part, a portion of the base part corresponding to the drain pump may be projected in a bottom direction, and the soundproof panel may include an opening formed in an area corresponding to the drain pump.

The soundproof panel may contain metallic material and include a bead projected from one side in a direction of the other side. The one side and the other side direction may include a top side or a bottom side.

The bead may extend to form a closed curve. And, the bead may extend while maintaining a uniform distance from an outline of the soundproof panel.

The apparatus may further include a sound absorption material attached to a top side of the soundproof panel confronting the base part. The sound absorption material may include polyethylene terephthalate (PET) or Websuler and contain a fibrous tissue. And, the fibrous tissue may include a porous tissue.

The sound absorption material may have a thickness between 4~10 mm.

The soundproof panel may have a thickness between 0.4~1.0 mm.

The soundproof panel may contain a metallic material and the base part may contain injection-molded plastic.

Accordingly, the present disclosure may have the following effects and/or advantages.

Firstly, a laundry treatment apparatus according to the present disclosure cuts off noise through a bottom base by minimizing the weight increase and the cost increase due to material addition, thereby enhancing usability.

Secondly, a soundproof panel for noise prevention of the present disclosure minimizes the disposition changes of the existing base structure and internal components, thereby obtaining a noise reduction effect.

Further scope of applicability of the present disclosure will become apparent from the detailed description given hereinafter. However, it should be understood that the detailed description and specific examples, while indicating preferred embodiments of the disclosure, are given by illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings, which are given by illustration only, and thus are not limitative of the present disclosure, and wherein.

DETAILED DESCRIPTION

Description will now be given in detail according to exemplary embodiments of a laundry treatment apparatus and control method thereof disclosed herein, with reference to the accompanying drawings. For the sake of brief description with reference to the drawings, the same or equivalent components may be provided with the same reference numbers, and description thereof will not be repeated.

Figure 1:
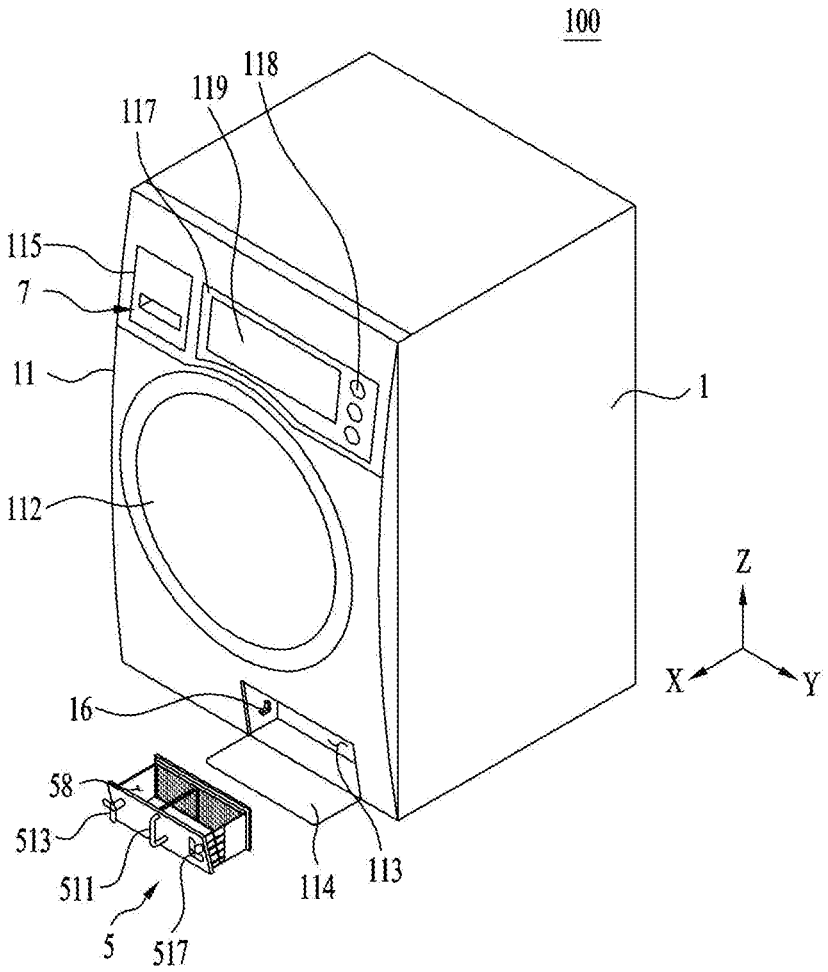
FIG. 1 and FIG. 2 are diagrams showing one example of a laundry treatment apparatus.
Figure 2:
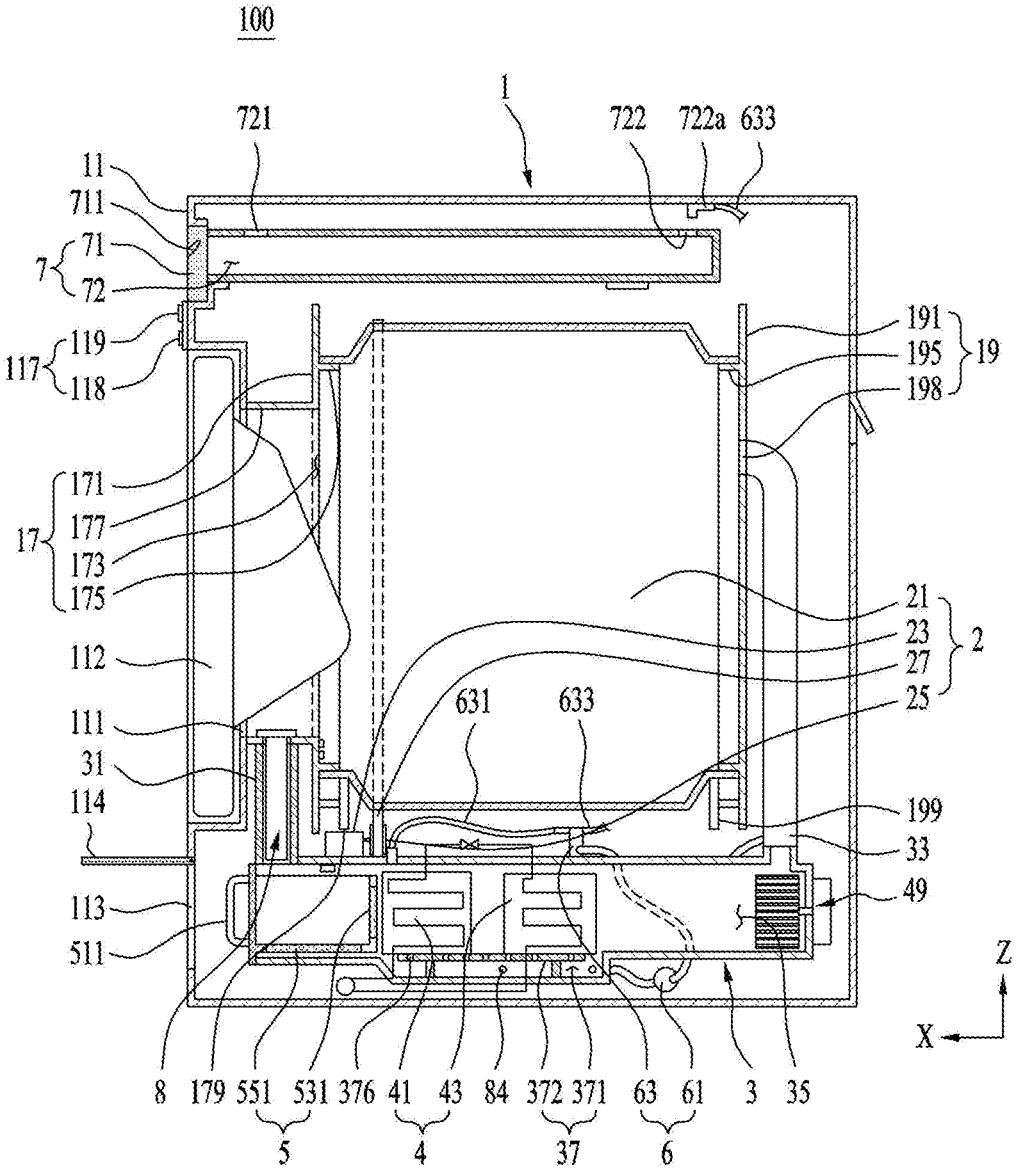

FIG. 1 and FIG. 2 are diagrams showing one example of a laundry treatment apparatus 100. As shown in FIG. 2, the laundry treatment apparatus 100 may include a cabinet 1, a drum 2 rotatably installed within the cabinet 1 so as to provide a space for receiving laundry therein, a duct 3 forming a flow path for resupplying air discharged from the drum 2 to the drum 2, and a heat exchange part 4 configured to dehumidify the air flowing into the duct 3, heat the dehumidified air and then resupply the heated air to the drum 2.

As shown in FIG. 1, the cabinet 1 includes a front panel 11 forming a front side of the laundry treatment apparatus. An entrance 111 configured to communicate with the drum 2 and a door 112 rotatably coupled to the cabinet 1 so as to open/close the entrance 111 may be provided to the front panel 11.

A control panel 117 is provided to the front panel 11. An input part 118 receiving an input of a control command from a user and a display part 119 outputting information such as a user-selectable control command and the like may be provided to the control panel 117.

The input part 118 may include a power supply request part requesting a power supply to the laundry treatment apparatus, a course input part enabling a user to select a desired course from a multitude of courses, and an execution request part requesting an initiation of the course selected by the user. The display part 119 may be configured to include at least one of a display panel capable of outputting a text and a diagram and a speaker capable of outputting an audio signal and sound.

As shown in FIG. 2, when the drum 2 includes a drum body 21 in a cylindrical shape of which front and rear sides are open each, a first support part 17 rotatably supporting the front side of the drum 2 and a second support part 19 rotatably supporting the rear side of the drum 2 may be provided within the cabinet 1.

The first support part 17 may include a first fixing body 171 fixed to an inside of the cabinet 1, a drum entrance 173 configured to perforating the first fixing body 171 so as to enable the entrance 111 and an inside of the drum body 21 to communicate with each other, and a first support body 175 provided to the first fixing body 171 so as to be inserted in a front side (i.e., a first open side) of the drum body 21.

The first fixing body 171 may be configured in any shape capable of having the drum entrance 173 and the first support body 175. The first support body 175 may be configured in a pipe shape protruding toward the drum body 21 from the first fixing body 171. A diameter of the first support body 175 may set greater than that of the drum entrance 173 and smaller than a front side diameter of the drum body 21. In this case, the drum entrance 173 may be located within a space formed by the first support body 175.

Figure 3:
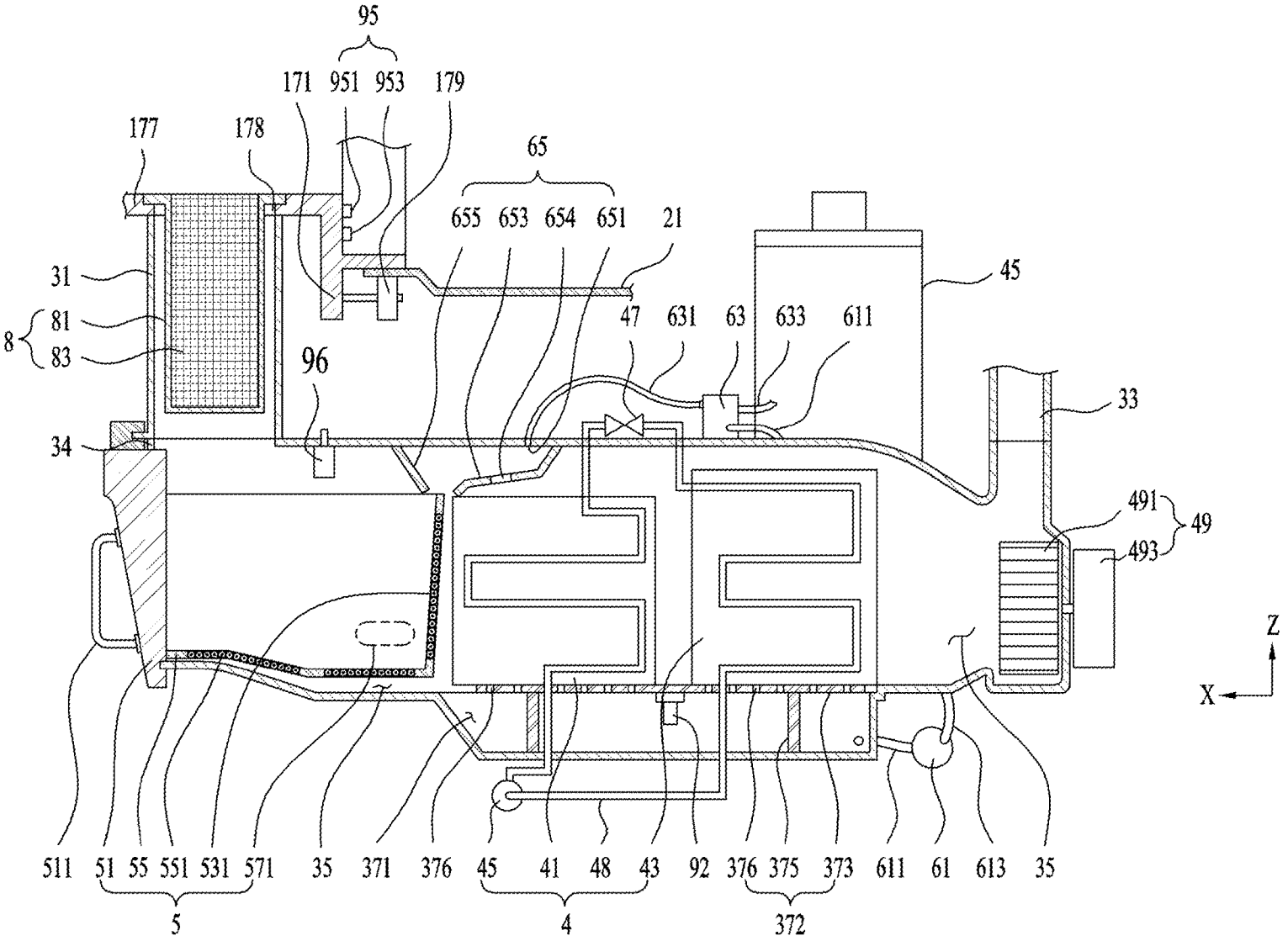
FIG. 3 is a diagram showing one example of a heat exchange part and a wash part provided to a laundry treatment apparatus.

The first support part 17 may be configured to further include a connecting body 177 connecting the entrance 111 and the drum entrance 173 together. The connecting body 177 may be configured in a pipe shape extending from the drum entrance 173 toward the entrance 111. An air outlet 178 communicating with the duct 3 may be provided to the connecting body 177. As shown in FIG. 3, the air outlet 178 may be configured as a perforated hole perforating the connecting body 177 so as to play a role as a path for moving the air in the drum body 21 to the duct 3.

As shown in FIG. 2, the second support part 19 may include a second fixing body 191 fixed to an inside of the cabinet 1 and a second support body 195 provided to the second fixing body 191 so as to be inserted in a rear side (i.e., a second open side) of the drum body 21. An air inlet 198 perforating the second fixing body 191 is provided to the second support part 19 so as to enable the inside of the drum body 21 to communicate with the inside of the cabinet 1. In this case, the duct 3 may be configured to connect the air outlet 178 and the air inlet 198 to each other.

The drum body 21 in a hollow cylindrical shape may be rotated through various types of drive parts. Particularly, FIG. 2 shows one example of a case that the drive part is configured to include a motor 23 fixed to an inside of the cabinet 1, a pulley rotated by the motor 23, and a belt 27 connecting a circumference of the pulley 25 and a circumference of the drum body 21 together.

In this case, a first roller 179 rotatably supporting the circumference of the drum body 21 may be provided to the first support part 17, and a second roller 199 rotatably supporting the circumference of the drum body 21 may be provided to the second support part 19.

The duct 3 may be configured to include an exhaust duct 31 connected to the air outlet 178, a supply duct 33 connected to the air inlet 198, and a connecting duct 35 connecting the exhaust duct 31 and the supply duct 33 together.

The heat exchange part 4 may be configured with various devices capable of sequentially progressing dehumidification and heating of air flowing into the duct 3. And, the heat exchange part 4 may be configured with a heat pump for example.

The heat exchange part 4 may include a fan 49 moving air along the duct 3, a first heat exchanger (e.g., a heat absorption part) 41 removing moisture from the air flowing into the duct 3, and a second heat exchange part (e.g., a heating part) 43 provided within the duct 3 so as to heat the air having passed through the first heat exchanger 41.

The fan 49 may include an impeller 491 provided within the duct 3 and an impeller motor 493 rotating the impeller 491. The impeller 491 may be provided to any one of the exhaust duct 31, the connecting duct 35 and the supply duct 33. FIG. 3 shows one example of a case that the impeller 491 is provided to the supply duct 33 (a case that the impeller 491 is located in rear of the exothermic part).

The heat absorption part 41 may be configured with a multitude of metal plates disposed in a width direction (i.e., Y-axis direction) or height direction (i.e., Z-axis direction) of the connecting duct 35, and the heating part 43 may be configured with a multitude of metal plates disposed in the width or height direction of the connecting duct 35. The heat absorption part 41 and the heating part 43 are sequentially disposed within the connecting duct 35 along a direction from the exhaust duct 31 to the supply duct 33 and connected to each other through a refrigerant pipe 48 forming a circulation flow path of a refrigerant.

The refrigerant is moved along the refrigerant pipe 48 by a compressor 45 located outside the duct 3, and a pressure adjuster 47 adjusting a pressure of the refrigerant having passed through the heating part 43 is provided to the refrigerant pipe 48.

The heat absorption part 41 is a means for transferring heat of the air flowing into the exhaust duct 31 to the refrigerant, thereby cooling down the air and evaporating the refrigerant. The heating part 43 is a means for transferring the heat of the refrigerant having passed through the compressor 45 to the air, thereby heating the air and condensing the refrigerant. In this case, the moisture contained in the air may gather on a floor surface of the connecting duct 35 along a surface of the heat absorption part 41 when going through the heat absorption part 41.

To collect the water removed from the air passing through the heat absorption part 41, a water collecting part is provided to the heat treatment apparatus 100. FIG. 3 is a diagram showing one example of a case that the water collecting part 37 is located within the connecting duct 35.

The water collecting part 371 and 372 Shown in FIG. 3 may include a water collecting body 371 fixed to a floor surface of the connecting duct 35 so as to communicate with an inside of the connecting duct 35. To prevent the heat absorption part 41 and the heating part 43 from contacting with water (condensed water) stored in the water collecting body 371, a heat exchanger support part 372 may be further provided within the water collecting body 371. The heat exchanger support part 372 may include a support plate 373 contacting with the heat absorption part 41 and the heating part 43, a spacer 375 maintaining a spacing between the support plate 373 and a floor surface of the water collecting body 371, and a support plate perforated hole 376 configured to perforate the support plate 373.

The support plate perforated hole 376 may be provided to a space for supporting the heat absorption part 41 in a space provided by the support plate 373 only, or each of a space for supporting the heat absorption part and a space for supporting the heating part. If the support plate perforated hole 376 is provided under the heating part 43, the water having moved to the heating part 43 along the support plate 373 may be discharged to the water collecting body 371 (i.e., heat transfer efficiency can be prevented when the heating part contacts with water).

To minimize particles (e.g., lint, etc.) discharged from the drum body 21 and stacked on the heat absorption part 41 and the heating part 43, a filter part for filtering air may be further provided to the laundry treatment apparatus 100. FIG. 3 shows one example of a case that the filter part includes a first filter part 5 provided to the connecting duct 35 and a second filter part 8 provided to the exhaust duct 31.

The second filter part 8 may be provided as a means for filtering the air flowing into the exhaust duct 31 from the drum body 21. The first filter part 5 may be located between the second filter part 8 and the heat absorption part 41 and provided as a means for filtering the air having passed through the second filter part 8. A diameter of a filter hole provided to the first filter part 5 may be set smaller than that of a filter hole provided to the second filter part 8.

The second filter part 8 may include a frame 81 detachably inserted into the exhaust duct 31 through the air outlet 178 and a filter (i.e., a fourth filter) 83 provided to the frame 81 to filter air.

The first filter part 5 may be detachably provided to the connecting duct 35. In this case, a filter installation hole 113 (see FIG. 1) for taking out the first filter part 5 and an installation hole door 114 for opening/closing the filter installation hole 113 may be provided to a front panel 11 of the cabinet 1, and a duct perforated hole 34 (see FIG. 3) having the first filter part 5 inserted therein may be provided to the duct 3. Therefore, after separating first filter part 5 from the laundry treatment apparatus, if necessary, a user may remove particles remaining on the first filter part 5 and wash the first filter part 5.

As shown in FIG. 1 and FIG. 3, the first filter part 5 may include a filter part body 51, 55, 511, 513, 517 and 58 inserted in the filter installation hole 113 and the duct perforated hole 34 and located between the second filter part 8 and the heat absorption part 41 and a filter 531, 551 and 571 provided to the filter part body so as to filter fluid (e.g., air and water) moving to the heat absorption part 41 and the water collecting body 371.

The first filter part 5 may be configured to communicate with the exhaust duct 31 through a top side or second lateral side 58 of the filter part body. FIG. 1 shows one example of a case that the first filter part 5 is connected to the exhaust duct 31 through a top side perforated hole configured to perforate the top side of the filter part body and a lateral side perforated hole configured to perforate the second lateral side 58.

As shown in FIG. 2, a wash part 6 washing the first filter part 5 using the water stored in the water collecting body 371 and a drain part 7 discharging the water in the water collecting body 371 out of the water collecting body 371 may be further provided to the laundry treatment apparatus 100.

As shown in FIG. 3, the wash part 6 may be provided as a means for washing at least one of the first filter 531, the second filter 551, the third filter 571 and the heat absorption part 41 by spraying the water stored in the water collecting body 371 on the first filter part 5. The wash part 6 may include a spray part 65 provided to the duct 3 so as to supply water to the first filter part 5 and a pump 61 moving the water stored in the water collecting body 371 to the spray part 65.

The pump 61 may be connected to the water collecting part 371 and the spray part 65 through a first connecting pipe 611 and a second connecting pipe 613, respectively. If the laundry treatment apparatus 100 is configured to move the water of the water collecting body 371 to the spray part 65 and the drain part 7 using a single pump 61 only, the laundry treatment apparatus 100 may further include a flow path switch part 63. In this case, the flow path switch part 63 may be connected to the pump 61 through the second connecting pipe 613, the spray part 65 may be connected to the flow path switch part 63 through a spray part supply pipe 631, and the drain part 7 may be connected to the flow path switch part 63 through a drain part supply pipe 633.

The flow path switch part 63 may be provided with a valve controlling the opening/closing of the spray part supply pipe 631 and the opening/closing of the drain part supply pipe 633. Hence, the laundry treatment apparatus 100 may control the valve provided to the flow path switch part 63, thereby supplying the water stored in the water collecting body 371 to the spray part 65 or the drain part 7.

The spray part 65 shown in FIG. 3 may be configured to include a duct perforated hole 651 provided to perforate the connecting duct 35 so as to be connected to the spray part supply pipe 631, a first guide 653 guiding water supplied from the duct perforated hole to the first filter 531, and a second guide 655 guising at least one portion of the water supplied through the first guide 653 to a front side of the heat absorption part 41. In this case, the second guide 655 may be configured as a means for enabling the water to be supplied to the front side of the heat absorption part 41 via the first filter 531. Namely, the first filter 531 may be configured to be located between the first guide 653 and the second guide 655 when the first filter part 5 is fixed to the connecting duct 35, and the second guide 655 may be configured as an inclined surface inclined downward from a top side of the connecting duct 35 toward the first filter 531.

A guide perforated hole 654 may be further provided to the first guide 653. The guide perforated hole 654 is a hole configured to perforate the first guide 653, whereby water flowing into the duct perforated hole 651 may be supplied to a front area of the heat absorption part 41 through the guide perforated hole 654. The front area of the heat absorption part 41 means an area located in a direction toward the first filter 531 with reference to a vertical line that passes through a center of the heat absorption part 41.

As shown in FIG. 2, the drain part 7 may include a storage body 72 detachably provided to the cabinet 1 to provide a space for storing water therein and an inlet 722 configured to perforate the storage body 72 to lead the water discharged from the drain part supply pipe 633 to an inside of the storage body 72.

The storage body 72 may be configured as a tank of a drawer type that can be pulled out of the cabinet 1. In this case, a drain part installation hole, in which the storage body 72 is inserted, may be provided to the front panel 11 of the cabinet 1. A panel 71 is fixed to a front side of the storage body 72. The panel 71 may be configured to form a portion of the front panel 11 by being detachably coupled to the drain part installation hole.

The panel 71 may further include a recess 711 in which a user's hand is inserted. In this case, the panel 71 may play a role as a handle in drawing/inserting the storage body 72 from/in the cabinet 1.

The inlet 722 may be configured to be supplied with water discharged from a nozzle 722*a* fixed to the cabinet 1. The nozzle 722*a* may be fixed to a top panel 13 of the cabinet 1 so as to be located over the inlet 722 when the storage body 72 is inserted in the cabinet 1. In this case, the drain part supply pipe 633 may be configured to connect the nozzle 722*a* and the flow path switch part 63.

The above-configured drain part 7 may discharge the water stored in the storage body 72 in a manner that a user draws the storage body 72 from the cabinet 1 and then turns over or inclines the storage body 72 toward a direction in which the inlet 722 is located. To facilitate the water in the storage body 72 to be discharged through the inlet 722, a communicating hole 721 configured to perforate the top side of the storage body 72 may be further provided.

As shown in FIG. 3, the laundry treatment apparatus 100 preferably includes a water collecting part level sensing part 91 configured to measure a water level of the water collecting body 371 and transmit the measured water level to the controller. If the water collecting part level sensing part 91 is provided, the laundry treatment apparatus 100 may determine a timing of moving the water stored in the water collecting body 371 to the storage body 72, by which the water of the water collecting body 371 can be prevented from flowing backward to the connecting duct 35.

The water collecting part level sensing part 91 may include any device capable of sensing a water level in the water collecting body 371. FIG. 3 shows one example of a sensor configured with a multitude of electrodes differing from each other in length (e.g., a multitude of electrodes connected depending on a water level).

To determine an operation stop time of the heat exchange part 4 by determining a dryness degree of laundry, a dryness degree sensing part may be provided to the laundry treatment apparatus 100. The dryness degree sensing part may include at least one of an electrode sensor 95 configured to measure an amount of moisture contained in laundry by contacting with the laundry and a humidity sensor measuring humidity of air flowing into the duct 3 from the drum 2.

The electrode sensor 95 may include first and second electrodes 951 and 953 fixed to the first fixing body 171 so as to be contactable with laundry in the drum body 21. The higher the dryness degree becomes, the less the amount of the moisture contained in the laundry gets (i.e., electric resistance of the laundry increases). By observing the electric resistance measured when the two electrodes 951 and 953 are connected together through the laundry, the laundry treatment apparatus 100 can determine the dryness degree of the laundry. Meanwhile, the higher the dryness degree of the laundry becomes, the less the amount of the moisture contained in the air flowing into the duct 3 gets. Hence, by observing the humidity of the air flowing into the duct 3 through the humidity sensor, the laundry treatment apparatus 100 may determine the dryness degree of the laundry.

In addition, the laundry treatment apparatus 100 may further include a temperature sensing part 96 measuring the temperature of the air flowing into the duct 3. The temperature sensing part 96 may be located between the first filter 531 and the second filter 551 by being fixed to the top side of the connecting duct 35.

Figure 4:
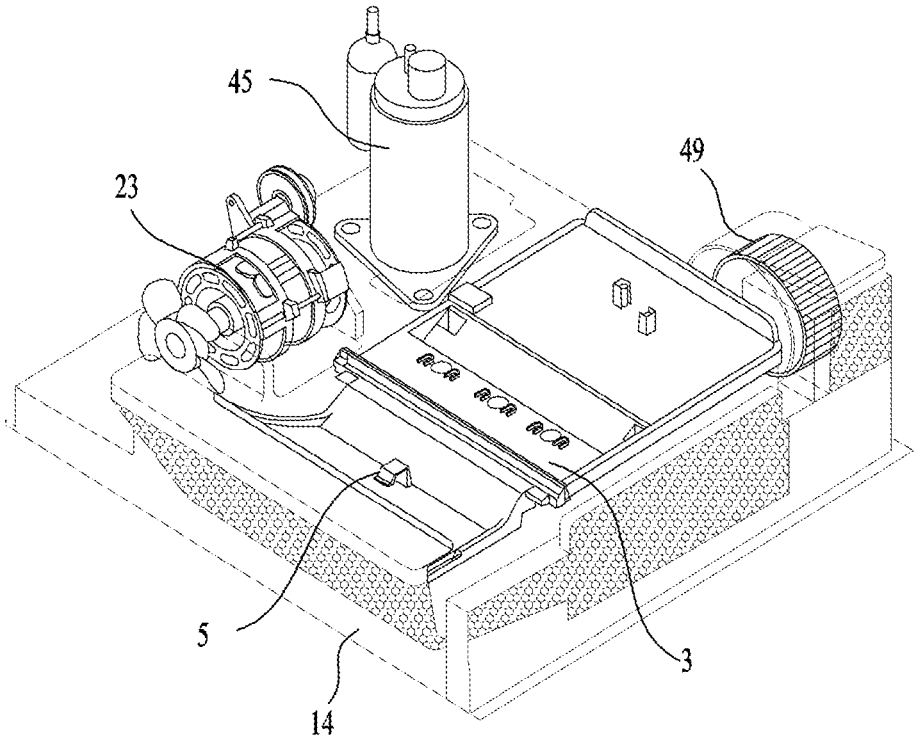
FIG. 4 is a diagram showing one example of disposition of components provided to the bottom of a laundry treatment apparatus.

FIG. 4 is a diagram showing one example of disposition of components provided to the bottom of the laundry treatment apparatus 100. As describe above, components (e.g., heat exchange part 4, compressor 45, fan 49, motor 23, etc.) other than the drum 2 located at the top of the laundry treatment apparatus 100 have prescribed weights, thereby being located at the bottom. Since laundry is loaded through the entrance 111 of the front side, the drum 2 for storing the laundry is rotated centering on an axis extending in front-rear direction. The duct 3 connected to the front and rear of the drum 2 extends in a front direction from a rear, as shown in FIG. 4, and the air is supplied to the drum again by dehumidified and heated through the heat exchange part 4 located within the duct 3.

Since the compressor 45 compressing the refrigerant of the heat exchange part 4 has a considerable volume, as shown in FIG. 4, it may be disposed outside the duct 3 instead of being located within the duct 3. Air in the drum 2 flows into the duct 3, and the hot air dried in the duct 3 moves to the drum again. The fan 49 enabling air circulation between the duct 3 and the drum 2 may be located in the direction of an entrance or exit of the duct 3. The fan 49 may be disposed in a backside direction of the laundry treatment apparatus 100 to prevent noise, which is generated from rotation of the fan 49, from reaching a user if possible. As the compressor 45 forces the refrigerant to be compressed using the motor 23, noise may be generated. Hence, the compressor 45 may be disposed in the backside direction as well. The noise generating components may be disposed in a manner of being inclined in the backside direction, by which the present disclosure is non-limited.

As the laundry treatment apparatus 100 equipped with the dry function is relatively light owing to the small number of components, the base part 14 of the bottom side may be formed by injection molding of plastic or the like. A rib structure or a honeycomb structure may be used to strengthen rigidity despite using the plastic or the like. If the rib or honeycomb structure is employed, a light structure with high rigidity can be implemented using small material.

Yet, as the density of injection-molded plastic is not high enough to cut off the noise generated from operation of internal components, it causes a problem of noise leakage. For the noise cutoff, the base part 14 may be formed of metallic material of high density. However, since the inside of the laundry treatment apparatus 100 is hot and humid, the base part of the metallic material is vulnerable to corrosion and performance of the compressor 45 may be affected. Therefore, it is necessary to add a structure capable of noise cutoff by maintaining the existing structure. If a structure of encapsulating each component is added, more space needs to be secured inside and there is a problem of vulnerability to a hot and humid environment.

Figure 5:
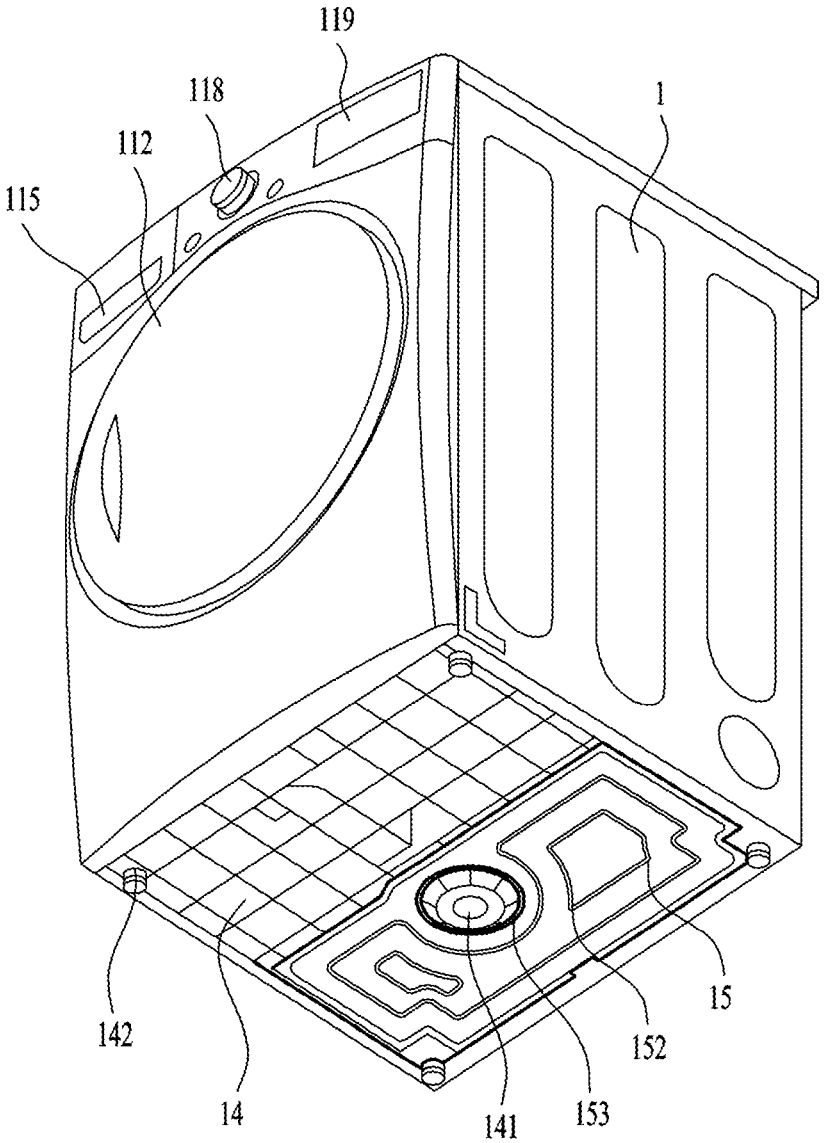
FIG. 5 is a diagram showing a base part and a soundproof panel of a laundry treatment apparatus.

In some implementations, it is necessary to consider a method of cutting off noise leaking through a bottom side by adding a soundproof panel 15 to a bottom side of the base part 14 of the laundry treatment apparatus 100. FIG. 5 is a diagram showing the base part 14 and the soundproof panel 15 of the laundry treatment apparatus 100, in which the soundproof panel 15 may be further added to the bottom side of the base part 14. The soundproof panel 15 may contain high-density material such as metal. As the soundproof panel 15 can be isolated from the hot and humid environment inside through the base part 14 of the injection-molded plastic, although the soundproof panel 15 contains the metallic material, it is free from corrosion. In addition, as shown in FIG. 5, since the base part 14 is partially covered, the weight of the laundry treatment apparatus 100 is not increased and the material cost increase can be minimized.

A bottom of a first area of the base part 14 may be covered with the soundproof panel 15 and a second area of the base part 14 may be exposed. The soundproof panel 15 is disposed on the first area in which such components, which generate noise upon operation, as the compressor 45 and the fan 49 are disposed, thereby minimizing the noise leakage. A plurality of support legs 142 are projected from the bottom side of the base part 14, whereby the base part 14 does not contact with a floor in direct. To prevent the soundproof panel 15 from contacting with a support space in direct, the soundproof panel 15 may be formed thinner than the height of the support legs 142.

Figure 6A:
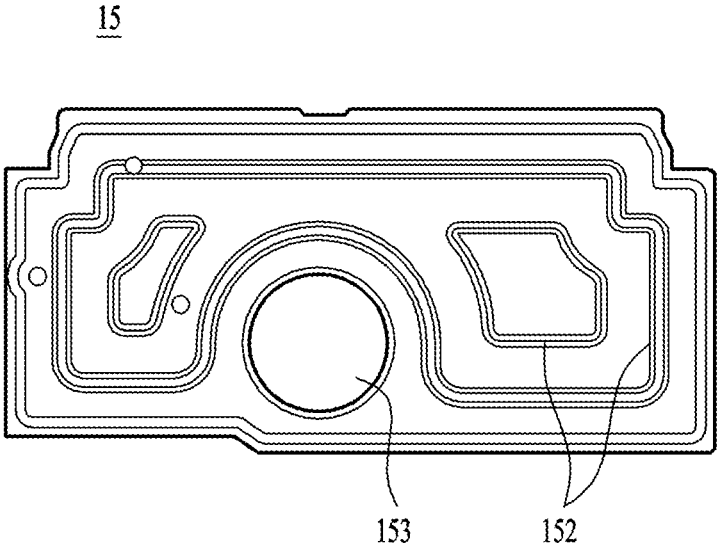
FIGS. 6A and 6B are diagrams showing one surface and the other surface of a soundproof panel of a laundry treatment apparatus.
Figure 6B:
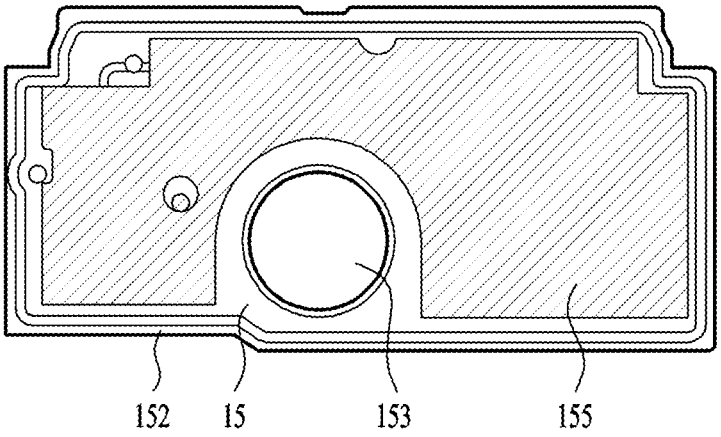

FIGS. 6A and 6B are diagrams showing bottom and top surfaces of the soundproof panel 15 of the laundry treatment apparatus 100. The soundproof panel 15 may be configured to correspond to a shape of the first area to cove the first area, and a drain pump 141 for removing the water collected in the water collecting part 37 from the duct 3 may be disposed in a manner of being projected in a direction lower than the duct 3 for the smooth drainage. In some implementations, the drain pump 141 may be provided in the first area and can be configured to remove the moisture removed from the air passing through the heat exchange part from the heat exchange part. Namely, a portion corresponding to the drain pump 141 of the base part 14 may be projected. In case that the drain pump 141 is disposed in the first area, as shown in FIG. 5, an opening 153 may be formed in the portion corresponding to the drain pump 141.

As the components installed in the cabinet 1 are disposed to operate continuously for air circulation, some of the components disposed in the first area may be projected in a bottom direction. In this case, the soundproof panel 15 of the corresponding portion may be skipped.

As shown in FIG. 6A, a bead 152 may be formed on the soundproof panel 15. To raise rigidity and cutoff effect, the bead 152 may be formed thick. Yet, if so, weight is increased and the cost of material is raised as well. Hence, the bead 152 may be formed by being projected in a manner of pushing one surface of the soundproof panel 15 in a direction of the other surface.

The bead 152 may be configured to form a continuous closed curve. If the bead 152 has a disconnected form instead of being formed continuously, rigidity of the disconnected portion is relatively weak. Hence, as stress is concentrated on the disconnected portion, the bead 152 may be broken. If the bead 152 is configured as a closed curve, overall rigidity of the structure can be raised evenly. Particularly, for the uniform rigidity of the soundproof panel 15, the closed curve of the bead 152 may extend along an outline of the soundproof panel 15 while maintaining a predetermined distance.

As shown in FIGS. 6A and 6B, a plurality of the beads 152 may be disposed. As described above, if the bead 152 is skipped partially, a bent closed curve can be formed by regarding the skipped portion as an outline. If the bead 152 is formed on the soundproof panel 15, sufficient rigidity can be secured with the thickness between 0.4~1.0 mm, whereby the weight and cost increases occurring due to the increased thickness of the soundproof panel 15 can be minimized. Although the soundproof panel 15 plays a role in cutting off noise, the noise may be reflected to cause a problem of sound leakage. Therefore, a sound absorption material 155 may be added to the top side of the soundproof panel 15 so as to prevent the sound touching the soundproof panel 15 from leaking out by being reflected.

The sound absorption material 155 may employ a member having elasticity of a porous structure, and include a fibrous tissue configured in fabric form by consisting of thin threads. Since the sound absorption material 155 needs prescribed elasticity, it may include polyethylene terephthalate (PET) or Websuler. The sound absorption material 155 may be disposed in a space between the base part 14 and the soundproof panel 15. The thicker the soundproof panel 15 gets, the better the sound absorption effect becomes. Yet, since the sound absorption material 155 cannot be formed thicker than the space between the base part 14 and the soundproof panel 15, the sound absorption material 155 may have thickness between 4~10 mm.

As described above, the laundry treatment apparatus 100 according to the present disclosure cuts off noise through the bottom base while minimizing the weight increase and the cost increase due to the material addition, thereby being easily added to the existing laundry treatment apparatus 100.

And also, a soundproof panel for noise prevention of the present disclosure can minimize the disposition changes of the existing base structure and internal components, thereby obtaining a noise reduction effect.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. An apparatus for laundry treatment, comprising:

a cabinet defining an entrance at one side and a base part at a bottom;

a drum defining a space for receiving laundry therein;

a duct connected to the drum;

a fan provided in a first area of the base part and configured to move air in the drum into the duct;

a heat exchange part including a heat absorption part configured to remove moisture from the air moved into the duct and a heating part configured to heat the air having passed through the heat absorption part;

a compressor provided in the first area of the base part and configured to increase a temperature of the air passing through the heat exchange part by compressing a refrigerant having passed through the heat absorption part;

a water collecting part configured to receive the moisture removed by the heat exchange part; and a soundproof panel configured to reduce noise and provided at the first area of a bottom of the base part that is located at the bottom of the cabinet, wherein the water collecting part comprises a drain pump provided in the first area and configured to remove the moisture from the heat exchange part, wherein a portion of the base part corresponding to the drain pump is projected in a bottom direction, wherein the soundproof panel comprises an opening defined in an area corresponding to the portion of the base part projected in the bottom direction, and wherein the portion of the base part corresponding to the drain pump passes through the opening.

2. The apparatus of claim 1, wherein the base part comprises a second area having a bottom side exposed without overlapping with the soundproof panel.

3. The apparatus of claim 1, wherein the entrance is located at a front side of the cabinet, and wherein the first area is located at a rear side of the base part.

4. The apparatus of claim 1, wherein the soundproof panel includes a metallic material and comprises a bead projected from a first side of the soundproof panel to a second side of the soundproof panel, the second side being opposite from the first side.

5. The apparatus of claim 4, wherein the bead extends to form a closed curve.

6. The apparatus of claim 5, wherein the bead extends while maintaining a uniform distance from an outline of the soundproof panel.

7. The apparatus of claim 1, further comprising a sound absorption material attached to a top side of the soundproof panel confronting the base part.

8. The apparatus of claim 7, wherein the sound absorption material comprises polyethylene terephthalate (PET) and includes a fibrous tissue.

9. The apparatus of claim 7, wherein the sound absorption material has a thickness between 4 mm and 10 mm.

10. The apparatus of claim 7, wherein a thickness of the sound absorption material is thinner than a space between the base part and the soundproof panel.

11. The apparatus of claim 1, wherein the soundproof panel has a thickness between 0.4 mm and 1.0 mm.

12. The apparatus of claim 1, wherein the soundproof panel comprises a metallic material, and wherein the base part comprises injection-molded plastic.

13. The apparatus of claim 1, further comprising:

a plurality of support legs projected from the bottom of the base part, wherein the base part not configured to contact with a floor.

14. The apparatus of claim 13, wherein the soundproof panel is thinner than a height of the plurality of support legs.

15. The apparatus of claim 1, wherein the fan is included in the heat exchange part.

16. The apparatus of claim 1, wherein the heat exchange part is provided within the duct.

17. The apparatus of claim 1, wherein the fan is disposed at an opposite side of the entrance.

18. The apparatus of claim 1, wherein the compressor is disposed at an opposite side of the entrance.

19. The apparatus of claim 1, wherein the soundproof panel is configured to reduce the noise from at least one of the compressor or the fan.

20. The apparatus of claim 1, wherein the soundproof panel is configured to correspond to a shape of the first area.

* * * * *